US006402595B1

(12) United States Patent
Fiesser

(10) Patent No.: US 6,402,595 B1
(45) Date of Patent: Jun. 11, 2002

(54) METHOD FOR CHEMICAL MECHANICAL POLISHING

(75) Inventor: Frederick H. Fiesser, Furlong, PA (US)

(73) Assignee: Rodel Holdings Inc., Wilmington, DE (US)

( * ) Notice: Subject to any disclaimer, the term of this patent is extended or adjusted under 35 U.S.C. 154(b) by 23 days.

(21) Appl. No.: 09/610,820

(22) Filed: Jul. 6, 2000

Related U.S. Application Data

(60) Provisional application No. 60/150,966, filed on Aug. 27, 1999.

(51) Int. Cl.[7] ..... B24B 1/00
(52) U.S. Cl. ..... 451/41; 451/285; 451/286
(58) Field of Search ..... 451/285, 286, 451/287, 288, 289, 41

(56) References Cited

U.S. PATENT DOCUMENTS 5,759,918 A 6/1998 Hoshizaki et al.
6,110,025 A * 8/2000 Williams et al. ..... 451/286
6,179,956 B1 * 1/2001 Nagahara et al. ..... 451/289
6,196,896 B1 * 3/2001 Sommer ..... 451/14
6,276,998 B1 * 8/2001 Sommer et al. ..... 451/285

* cited by examiner

*Primary Examiner*—Joseph J. Hail, III
*Assistant Examiner*—Hadi Shakeri
(74) *Attorney, Agent, or Firm*—Konrad Kaeding; Gerald K. Kita; Kenneth A. Benson

(57) ABSTRACT

A semiconductor wafer is polished by a method which avoids constant instantaneous relative velocity between the wafer and an abrasive medium. The wafer is held by a tooling head and is contacted by an abrasive pad which is fixedly attached to a table. At least one of the tooling head and the table is movable relative to the other. A controller governs movement of the tooling head and/or the table according to a predetermined polishing pattern to initially effect a uniform instantaneous relative velocity between the wafer and the abrasive pad. The wafer is held by the tooling head in an initial orientation with respect to the abrasive pad. By changing the orientation of the wafer with respect to the abrasive pad, the instantaneous relative velocity changes for at least some point on the wafer.

1 Claim, 9 Drawing Sheets

METHOD FOR CHEMICAL MECHANICAL POLISHING

This application claims the benefit of U.S. Provisional Application No. 60/150,966 filed Aug. 27, 1999.

BACKGROUND OF THE INVENTION

1. Technical Field

The present invention relates to the chemical mechanical polishing or planarizing of semiconductor and similar-type substrates. More specifically, the substrate is non-rigidly held by a tooling head and is polished by contact with an abrasive material in a controlled, chemically active environment.

2. Discussion of the Related Art

U.S. Pat. No. 5,759,918 to Hoshizaki et al is directed to a method for chemical mechanical polishing. Hoshizaki teaches a polishing pattern which "maintains substantially constant instantaneous relative velocity between the polishing medium and all points on the substrate to be polished." Such a design is however problematic.

The "constant instantaneous relative velocity" taught in Hoshizaki will compound any flaws in the polishing substrate. For example, if unwanted debris contaminates the polishing medium as the medium is installed on the tool, then the exact same portion of the substrate will be harmed by the contamination, over and over again during the polishing operation.

This problem could be addressed by periodically indexing a web of polishing medium. However, indexing merely creates a polishing medium having a continuum of oldest to newest polishing medium When such an indexed polishing medium is used in accordance with the Hoshizaki patent, the "substantially constant instantaneous relative velocity between the polishing medium and all points on the substrate to be polished" causes certain portions of the substrate to be polished by the newer portions of the polishing medium and other portions of the substrate to be polished by the older portions of the polishing medium.

Hence, indexing the polishing medium and practicing the polishing methods of Hoshizaki will result in a non-uniform, final polished product. However, without indexing, the polishing methods of Hoshizaki will cause any defect in the polishing medium to disproportionately harm only a particular portion of the substrate, thereby also causing non-uniform polishing.

Applicant has found a way to overcome the non-uniformity problems inherent in the teachings of Hoshizaki, while providing excellent planarization, reliability, ease of use, and low cost.

SUMMARY OF INVENTION

The present invention is directed to a method of chemical mechanical polishing and planarization of electronic substrates, including memory disks, blank silicon (or other semiconductor material) wafers, and/or patterned wafers (e.g., wafers supporting an integrated circuit or a precursor thereto). In a preferred embodiment, the substrate or wafer is held in a wafer carrier and the wafer is contacted by a polishing medium. The wafer is able to move relative to the wafer carrier during polishing or in other words is non-fixedly engaged by the carrier.

In this preferred embodiment, the wafer will define an initial orientation with respect to the carrier immediately prior to polishing. During polishing, the carrier and the polishing medium are moved relative to each other in a polishing pattern. The polishing pattern preferably defines a series of curves, and optionally also includes straight line movement between one or more curves. The polishing pattern maintains a substantially constant instantaneous relative velocity between the polishing medium and all points on the wafer. Also during polishing, the wafer moves relative to the carrier in a continuous or discontinuous fashion so as to change the initial orientation of the wafer in the carrier while the wafer substantially follows the movement of the carrier. This movement of the wafer relative to the carrier changes the substantially constant instantaneous relative velocity between at least one point on the wafer and the polishing medium by at least 0.01%, and preferably by at least 1% to 10%.

In one embodiment, the polishing pattern is conducted by moving the polishing medium and keeping the wafer carrier stationary. Alternatively, the polishing medium can be kept stationary and the wafer carrier moved in accordance with the polishing pattern.

According to the invention, the wafer may be rotated in the carrier on an axis extending perpendicular to the polishing medium In one embodiment, the wafer can angularly float in the carrier, and the wafer is induced to rotate in the carrier by frictional forces between the wafer and the polishing medium which are greater than frictional forces between the wafer and the carrier. In another embodiment, the wafer is coupled to the carrier to prevent float, and the carrier is mechanically driven to effect positive rotation of the wafer with respect to the polishing medium.

In an alternative embodiment, rather than measuring the instantaneous relative velocity between the wafer's initial position and the polishing medium, the instantaneous relative velocity is measured between the wafer during polishing and the polishing medium If the instantaneous relative velocity between the wafer (during polishing) is measured relative to the polishing medium, the relative velocity cannot match 100%, i.e., is not substantially constant. The velocity of one relative to the other must be different by at least about 0.1, 0.2, or 0.5 percent, but no more than about 1, 3, 5 or 10 percent.

In one embodiment, the polishing movements are controlled with control circuitry. Preferred control circuitry provides precise movement of the carrier relative to the polishing medium in accordance with the present invention.

DETAILED DESCRIPTION OF THE PREFERRED EMBODIEMENT(S)

Figure 1:
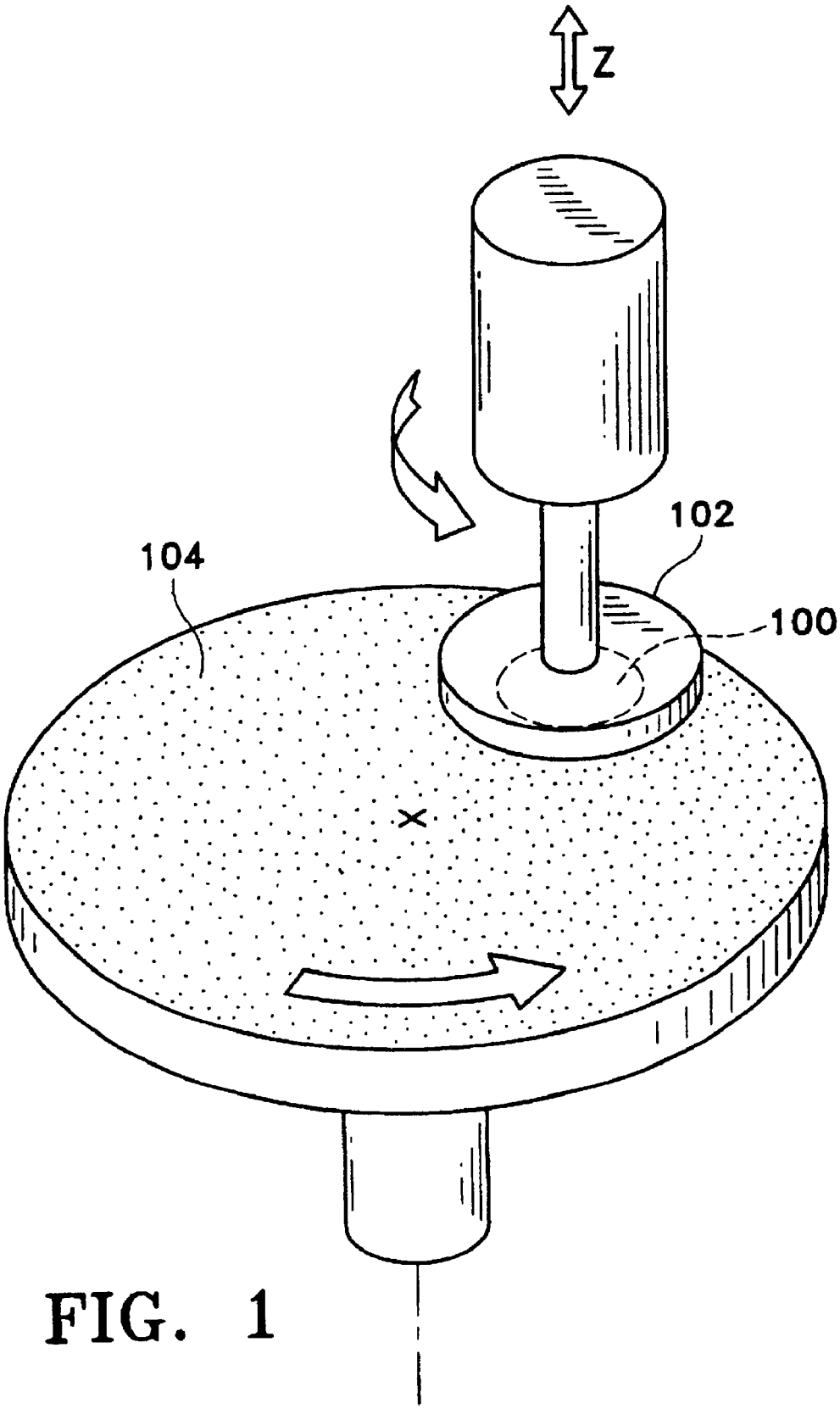
FIG. 1 is a simplified perspective view of an embodiment of the present invention, having a stationary rotating polishing media and a stationary rotating substrate, wherein both rotational components rotate in the same direction and at substantially the same revolutions per minute.

The following embodiments of the present invention will be described in the context of a method and apparatus for polishing semiconductor wafers, although those skilled in the art will recognize that the disclosed methods and structures are readily adaptable for broader application, e.g., polishing of other substrates. For example, the invention is readily adaptable for use in processing other types of disk shaped objects. Note that whenever the same reference numeral is repeated with respect to different figures, it refers to the corresponding structure in each such figure.

Figure 2:
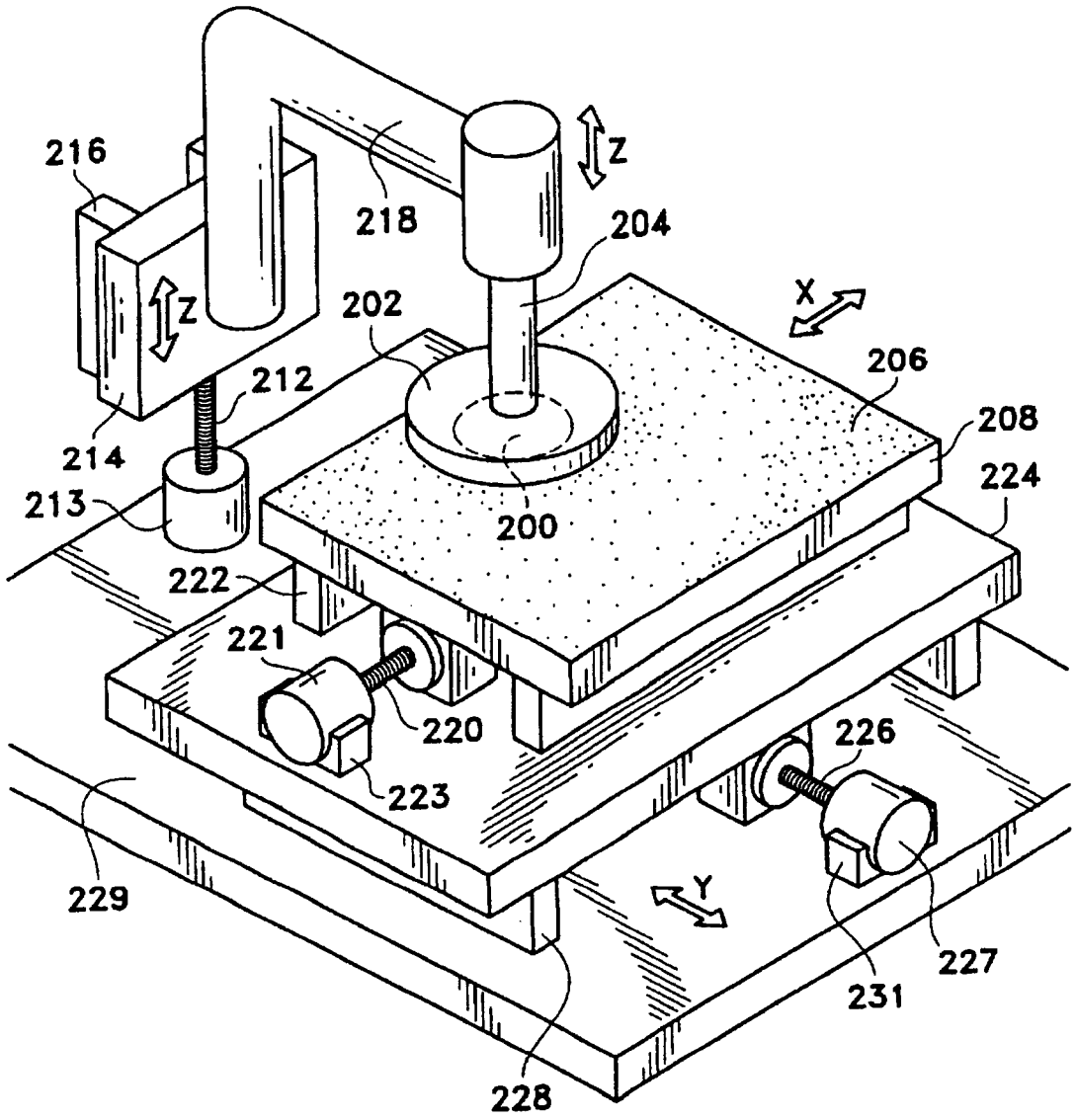
FIG. 2 is a front perspective view of a polishing apparatus according to the present invention, having a non-rotary movable polishing media and a stationary polishing substrate.

A method and apparatus for polishing semiconductor wafers according to the present invention is illustrated in FIG. 2. The rear side of wafer 200 is held by tooling head or wafer carrier 202, while the front side of wafer 200 is contacted by abrasive pad 206. Tooling head 202 is connected to a post 204 which may move tooling head or wafer carrier 202 and wafer 200 in the Z-direction, which is perpendicular to the plane of wafer 200, so that wafer 200 may be brought into contact with abrasive pad 206. Post 204 may also apply polishing force in the Z-direction on tooling head wafer carrier 202 and wafer 200. The Z-direction movement and force applied to tooling head 202 is provided by a servo. In this embodiment of the invention, the servo includes a lead screw 212, which pushes a plate 214 attached to a linear slide 216. Cross-member 218 is fastened to plate 214 and also to post 204. According to a preferred embodiment of the invention lead screw 212 is driven by an electric motor 213 mounted to base 229 and which is computer controlled so that the user may program the force applied during the polishing process. One skilled in the art will realize that other methods providing Z-direction movement and force are practicable.

According to this embodiment, post 204 and tooling head 202 hold wafer 200 in a substantially fixed position in X and Y-directions, which are parallel to the plane of wafer 200 and perpendicular to each other. However, the wafer 200 is not fixedly held by the tooling head 202. Instead, the wafer 200 has some mobility with respect to the tooling head. An initial position or orientation of the wafer in the tooling head is defined prior to commencement of a polishing operation. During polishing, the tooling head 202 permits or causes the wafer to rotate to some degree about an axis perpendicular to and passing through the center of the wafer 200. Thus, the wafer 200 experiences limited movement relative to the tooling head 202 during a polishing operation.

Table 208 is movable in both the X and Y-directions. According to a preferred embodiment of the invention, table 208 is movable in the X-direction by action of lead screw 220 and linear slide 222. Similarly table 208 is movable in the Y-direction by being mounted on plate 224 which is mounted to linear slide 228 and actuated by lead screw 226. Note that linear slide 228 is also mounted to base 229. In a preferred embodiment of the invention, lead screws 220 and 226 are driven by infinitely positionable electric motors 221 and 227 which are mounted to plate 224 and base 229 using brackets 223 and 227 respectively. Motors 221 and 227 are preferably computer controlled so that the user may program the table to move in an infinite number of patterns.

While lead screws are used in the presently preferred embodiment of the invention, one skilled in the art would recognize that other servo means would be practicable, for example a rack-and-pinion servo means.

Figure 3:
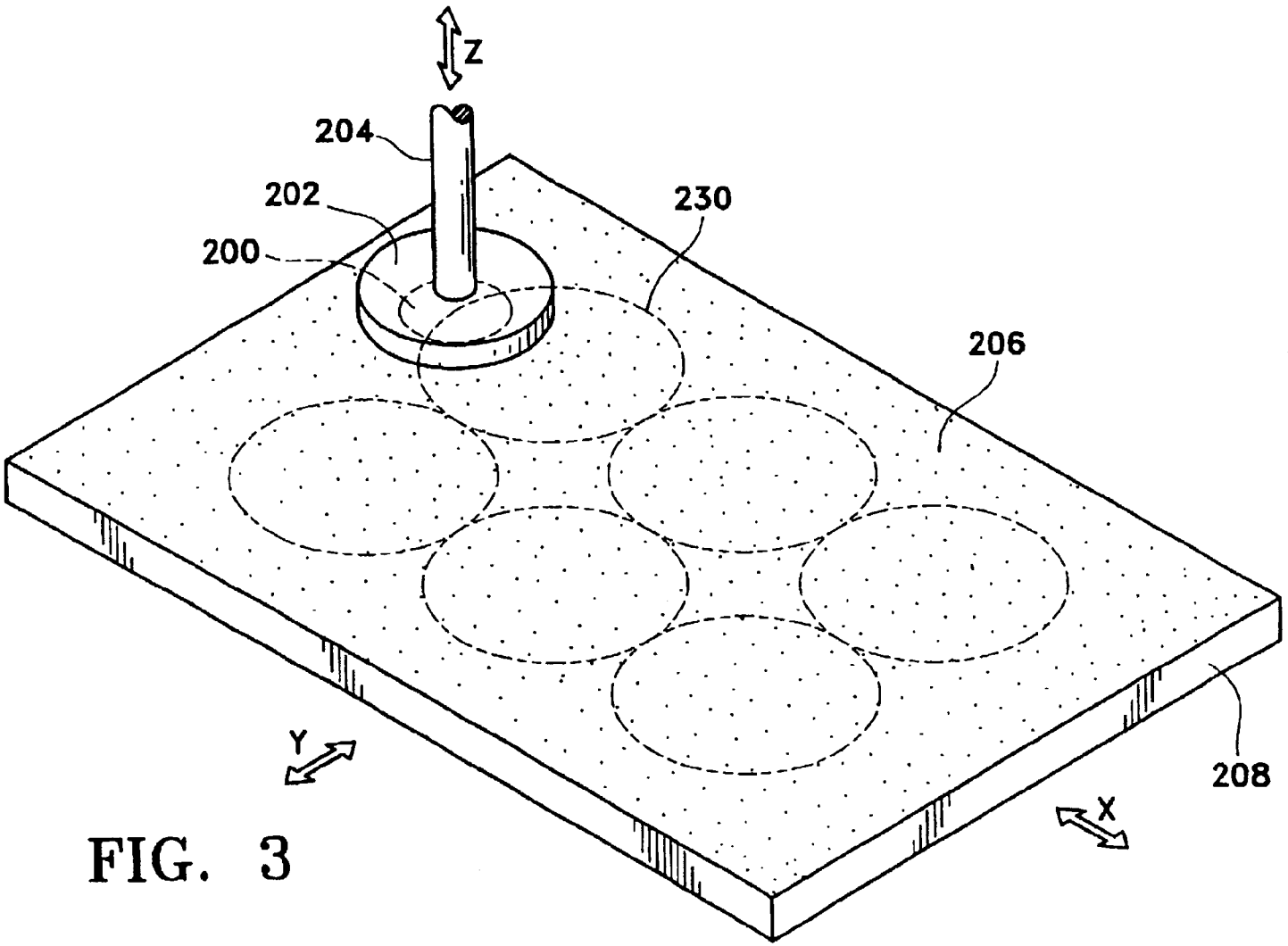
FIG. 3 is a front perspective view of a tooling head and an abrasive pad, showing a polishing pattern which is outlined by relative movement between the tooling head and the abrasive pad.

Movements of table 208 in the X and Y-directions while holding wafer 200 and tooling head 202 fixed in the X and Y-directions result in relative motion between the wafer 200 and abrasive pad 206. Shown in FIG. 3 is an example of a polishing pattern 230, which in this case is a series of tangent circles. The pattern shows a path traced by the center of wafer 200 as the abrasive pad 206 is moved beneath it.

Note that relative movement between the wafer 200 and the abrasive pad 206 solely in the X and Y-directions results in all points on the wafer experiencing the same instantaneous relative velocity with respect to the abrasive pad. Providing uniform relative velocity for all points on the wafer advantageously provides a substantially uniform removal rate of material from the wafer.

The user may program the movement of the abrasive pad and table such that the relative velocity of the wafer in its initial position with respect to the abrasive pad is substantially constant. According to the invention, this substantially constant relative velocity is altered by causing rotation of the wafer in the tooling head. Rotation may be caused by driving the wafer through a mechanical coupling in the tooling head.

Alternatively, the wafer may float in the tooling head and may be induced to rotate in the tooling head by external forces acting on the wafer which overcome frictional resistance between the wafer and the tooling head. In particular, relative motion between the wafer and the abrasive pad generates frictional force on the wafer, and when the relative motion is non-linear, this frictional force results in a torque on the wafer. When this torque is greater than the frictional force between the wafer and the tooling head, the wafer will rotate within the tooling head.

Figure 9:
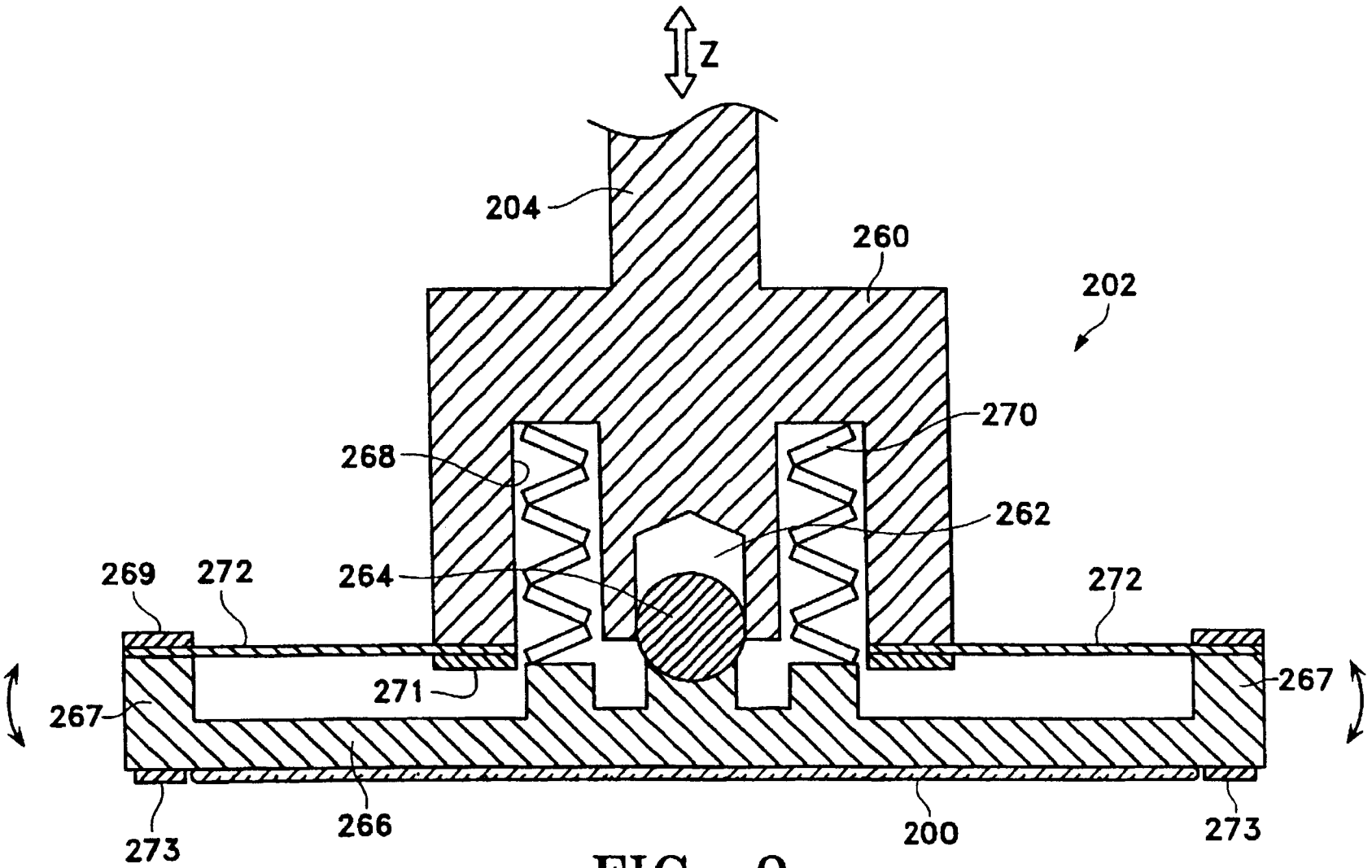
FIG. 9 is a side view cross-section of a tooling head of the present invention.

Force between the wafer and the abrasive pad may be controlled by compression springs 270 which reside in tooling head 202 (shown in FIG. 9). Since the tooling head is moveable in the Z-direction, under computer control, the user is free to program the force applied between the wafer and abrasive pad in order to improve slurry or cutting fluid distribution and cutting efficiency. For example, a variable force applied during polishing may in some cases improve polishing results.

Figure 4:
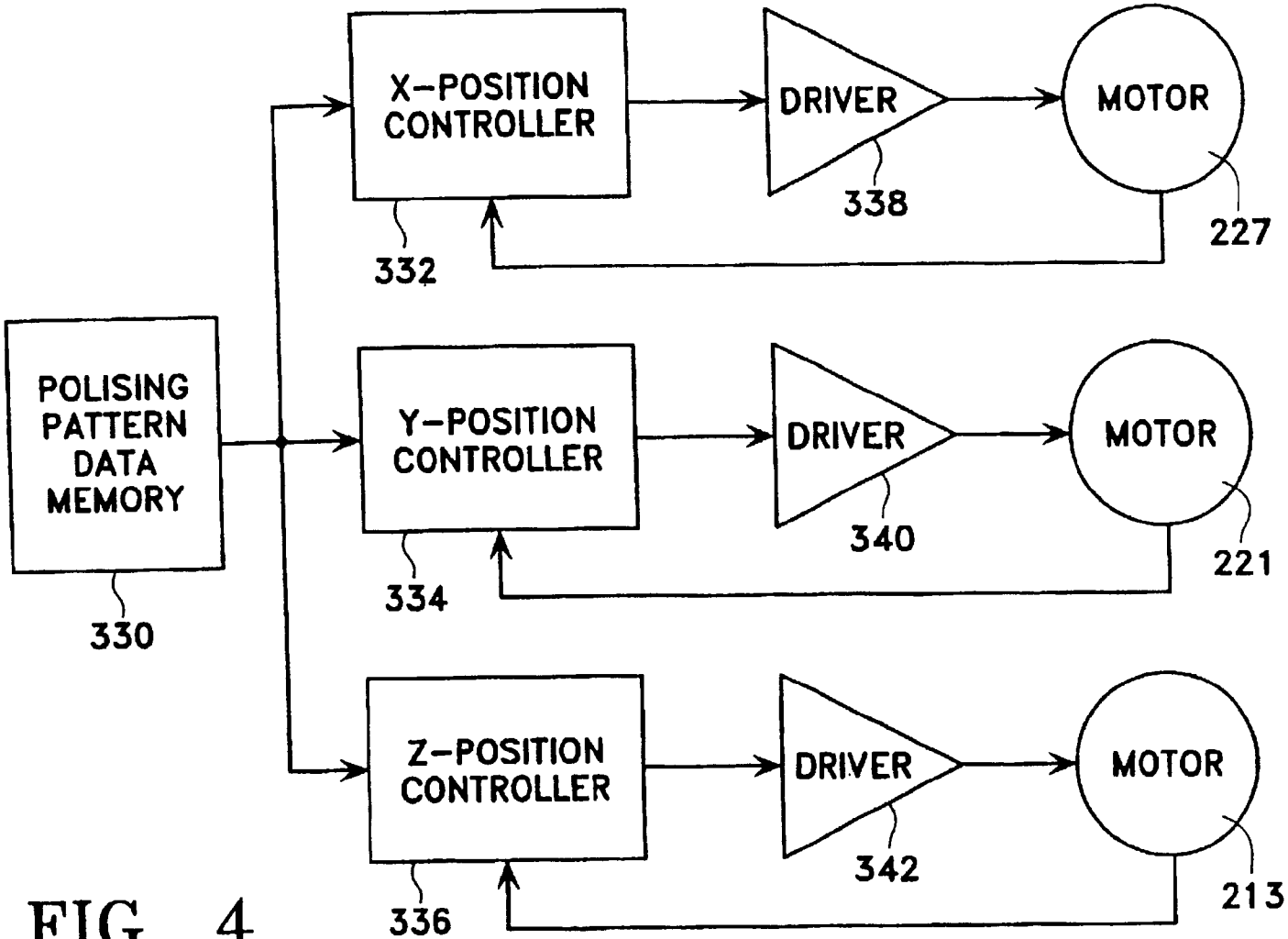
FIG. 4 is a block diagram illustrating control circuitry according to the present invention.

FIG. 4 is a block diagram illustrating in simplified form the control circuitry according to a preferred embodiment of the invention. Polishing pattern data memory 330 contains position information of table 206 in the X and Y-directions, and tooling head 202 and post 204 in the Z-direction according to a predetermined polishing pattern. The pattern data is received by the X, Y, and Z position controllers 332, 334, and 336. The position controllers compute the change in position required using both the position data from memory 330 and feedback information from the electronic motors. The change in position data is sent to motor drivers 338, 340, and 342, which use the received information to drive motors 227, 221 and 213. Preferably position encoders are provided on the motors or elsewhere which send position feedback to the position controllers. One of ordinary skill in the art may select the components needed for the control circuitry from many which are commercially available.

If uniform removal of material is desired, care must be taken in programming a particular polishing pattern so that the cut angle and leading edge of the wafer are sufficiently varied. The cut angle refers to the direction of relative movement that a point on the wafer sees with respect to the abrasive pad. If the cut angle is not sufficiently varied, grooves may be cut in the surface of the wafer.

Similarly, the leading edge of the wafer should be sufficiently varied during the polishing process, since the leading edge of the wafer experiences a higher rate of material removal. If the leading edge of the wafer is not varied sufficiently, non-uniform removal rates from different parts of the wafer may result. It has been found that circular and arc polishing patterns provide sufficient variations in both cut angles and leading edges of the wafer.

Thus, according to this embodiment of the present invention, a wafer polishing machine is provided which allows the user to program any polishing pattern desired. The user is not confined to a fixed polishing pattern, such as a fixed radius circle processing in a straight line as in prior art systems. With the current system, for example, the user may program the pattern to be a circle with a different radius. Rather than precessing in a straight line the user may choose a sine wave, a larger circle, or any combination of arcs, curves, or straight lines. The user may also program any of the precessing patterns to move in a "FIG. 8" pattern instead of a circle.

An advantage of providing a wide variety of alternative polishing patterns is that particular topologies on the surface of the wafer may be better planarized by selecting a more optimal polishing pattern.

Another advantage is that the user may program the polishing pattern such that uniform wear of the abrasive pad is achieved. According to a preferred embodiment uniform abrasive pad wear has been attained by polishing in a pattern of continuous arcs which together form a series of tangent circles.

Figure 5:
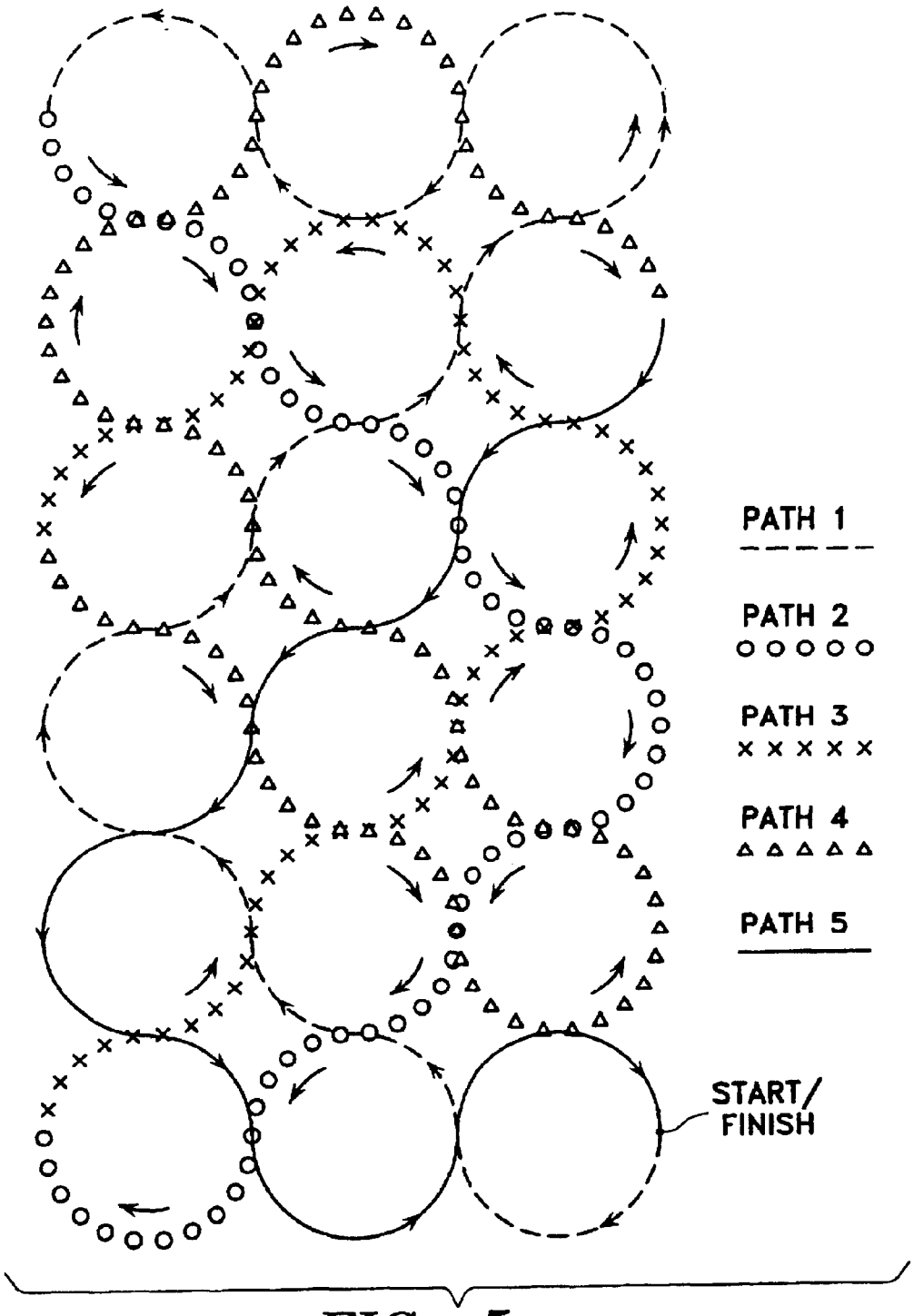
FIG. 5 is a top view of a polishing pattern according to the present invention.

FIG. 5 shows an example of one continuous arc polishing pattern. The continuous arc pattern shown comprises a series of arcs traced out by the center of a wafer being polished such that a series of tangent circles is drawn. Paths 1 to 5 are shown with different lines so that the reader may more easily follow the path of the wafer on the abrasive pad. In practice, the center of the wafer moves continuously from one path to the next, while maintaining a constant velocity during the polishing process.

The continuous arc pattern shown in FIG. 5 has been found to provide an extremely good polishing result for a number of reasons. Pad wear is uniform, since the wafer covers a large area in a uniform manner prior to repeating the pattern. The cut angle and leading edge of the wafer is continuously varied since the wafer is continuously in an arc motion. Uniform velocity is attained at all points on the wafer since the wafer does not rotate. Constant velocity can be maintained throughout the polishing pattern, so that a more uniform removal rate of material is attained.

Figure 6:
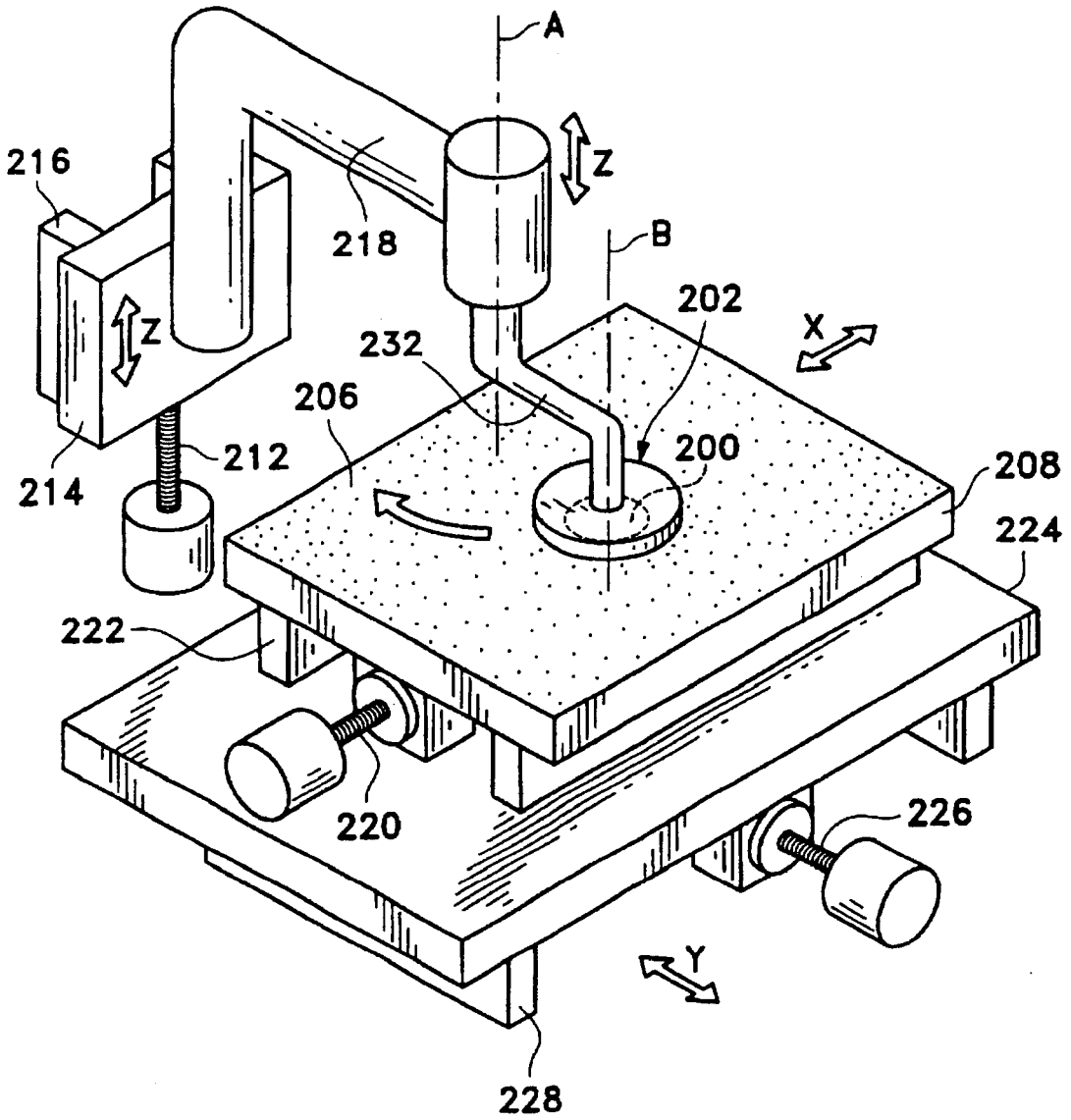
FIG. 6 is a front perspective view of a polishing apparatus with an eccentric arm, according to an alternative embodiment of the present invention.

FIG. 6 shows another embodiment of the present invention. In this variation, tooling head or wafer carrier 202 is connected to cross member 218 by eccentric arm 232. Eccentric arm 232 is rotatable about an axis "A" which is concentric with the upper portion of eccentric arm 232, so that tooling head 202 is moved in a circular path. Note that as in the previous embodiment abrasive pad 206 and table 208 are movable in the X and Y-directions by lead screws 220 and 226, and motion and force applied in the Z-direction are provided by lead screw 212.

According to this embodiment of the invention, the rotation of eccentric arm 232 is computer controlled, so that the user may precisely control the rotation speed. By rotating eccentric arm 232, tooling head 202 and wafer 200 are moved in a circular path about axis "A". If table 208 is also moved in the X and Y-directions, the resulting polishing pattern is that of a precessing circle. Unlike prior art systems which provide only straight-line precessing circles, this embodiment of the invention provides the user with unlimited precessing circle patterns. For example, the circular pattern may be made to precess in a larger circle or a sine wave pattern.

According to the invention, tooling head 202 and wafer 200 translate in a circular path about axis "A". At the same time, wafer 200 rotates about central axis "B". This translation along with rotation of the wafer results in a deviation from constant instantaneous relative velocity for all points of the wafer with the exception of the center of the wafer.

Figure 7A:
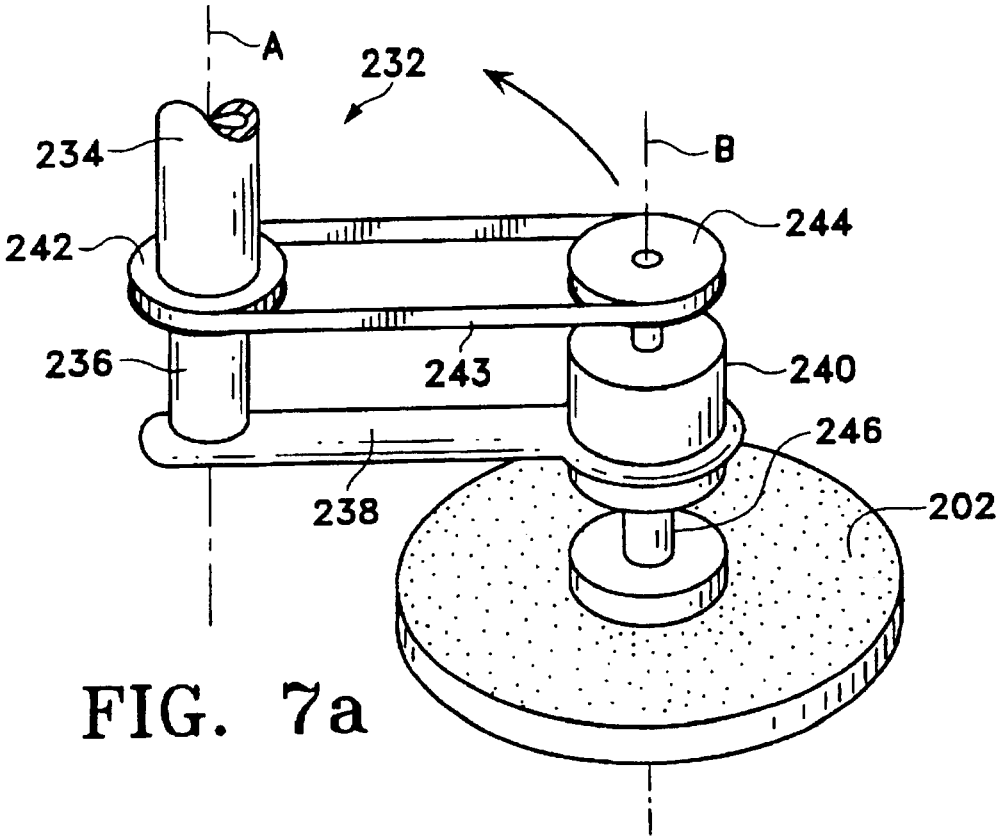
FIGS. 7*a* and 7*b* are front perspective views of the polishing apparatus with an eccentric arm, which include means for rotating a polishing substrate in the tooling head.
Figure 7B:
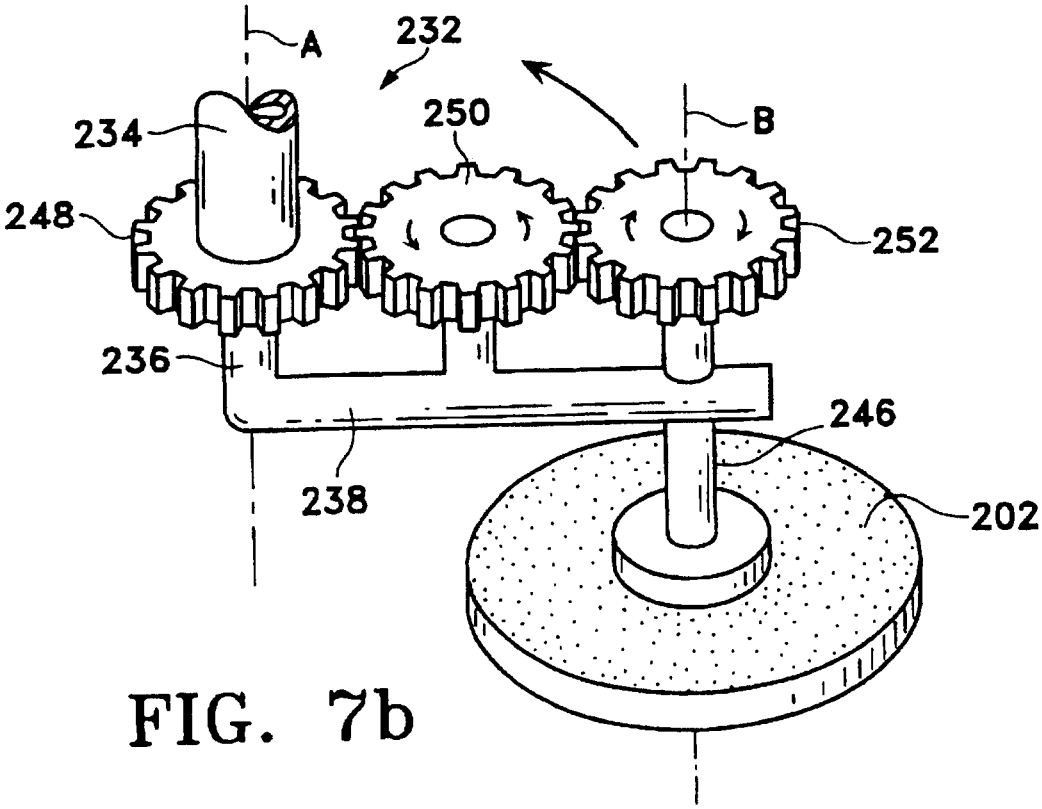

FIGS. 7*a* and 7*b* show two alternative embodiments of eccentric arm 232 and tooling head 202 which include structures to effect rotation of the wafer in the tooling head.

The structure shown in FIG. 7*a* uses a pulley and belt system. Movement along the circular path is provided by a rotating vertical post 236, which rotates inside a non-rotating fixed vertical post 234 and protrudes as shown. Eccentric cross member 238 is connected to rotating vertical post 236 and spindle 240. Fixed pulley 242 is fastened to fixed vertical post 234. Belt 243 is engaged to both fixed pulley 242 and head pulley 244. Head pulley 244, in turn, is fastened to head post 246 which passes through and is supported by spindle 240 and is fastened to tooling head 202.

In operation, rotating vertical post 236 spins and causes eccentric arm 238, spindle 240, head post 246 and tooling head 202 to move in a circular path. Fixed pulley 242 and head pulley 244 are sized to have some ratio other than one to one. Cooperation between fixed pulley 242, belt 243 and head pulley 244 ensures that tooling head 202 rotates as it moves through its circular path. The wafer is coupled for rotation with the tooling head such as by a flat or notch on the wafer which is engaged by a corresponding protrusion of the tooling head.

FIG. 7*b* show another embodiment of eccentric arm 232 which uses a series of gears to effect rotation of tooling head 202. As shown, fixed vertical post 234, rotating vertical post 236 and eccentric cross member 238 are provided in a fashion similar to the previous embodiment. In this embodiment, fixed gear 248 is fastened to fixed vertical post 234 and engages intermediate gear 250, which, in turn, engages head gear 252. Head gear 252 is fastened to head post 246. The gears 248, 250, 252 have some ratio other than one to one to one. In operation, eccentric cross member 238 rotates about axis of rotation "A," while the series of gears 248, 250, and 252 ensure that head post 246 and tooling head 202 rotate as they move in a circular motion about axis "A". The wafer is coupled for rotation with the tooling head as discussed above with reference to FIG. 7*a*.

Alternatively, the gears 248, 250, 252 may have a ratio of one to one to one. Further, vertical post 234 along with gear 248 are driven such as by a motor to cause rotation of head post 246 and tooling head 202 at some rate which is different than the rotation rate of the eccentric cross member 238. In this way, the tooling head 202 and the wafer are caused to change their angular orientation with respect to the abrasive pad.

Persons of ordinary skill in the art may select the appropriate gears or pulleys based on the length of arm 232 to achieve the effects as described herein.

Note that if a substantially constant, non-fluctuating velocity between the wafer and the abrasive pad is desired, the rotation speed of eccentric arm 232 may be programmed accordingly. In order to compensate for the relative X and Y-direction motion of the table 208, the rotation speed of eccentric arm 232 may be programmed to keep the linear speed between the wafer and the abrasive pad at a constant value. Preferably, the eccentric arm should rotate at a slower speed when the motion of the head has a component which is opposite in direction to the table motion component and at a faster speed when the head motion has a component in the same direction as that of the table.

Note further that relative rotation of the wafer with respect to the abrasive pad changes the substantially constant velocity between the wafer and the abrasive pad for all points of the wafer which are not on the rotation axis of the wafer. According to the invention, this change in the substantially constant velocity is preferably at least 0.01%, more preferably at least 0.1%, and even more preferably at least 1% to about 10%, for at least some point on the wafer.

Figure 8:
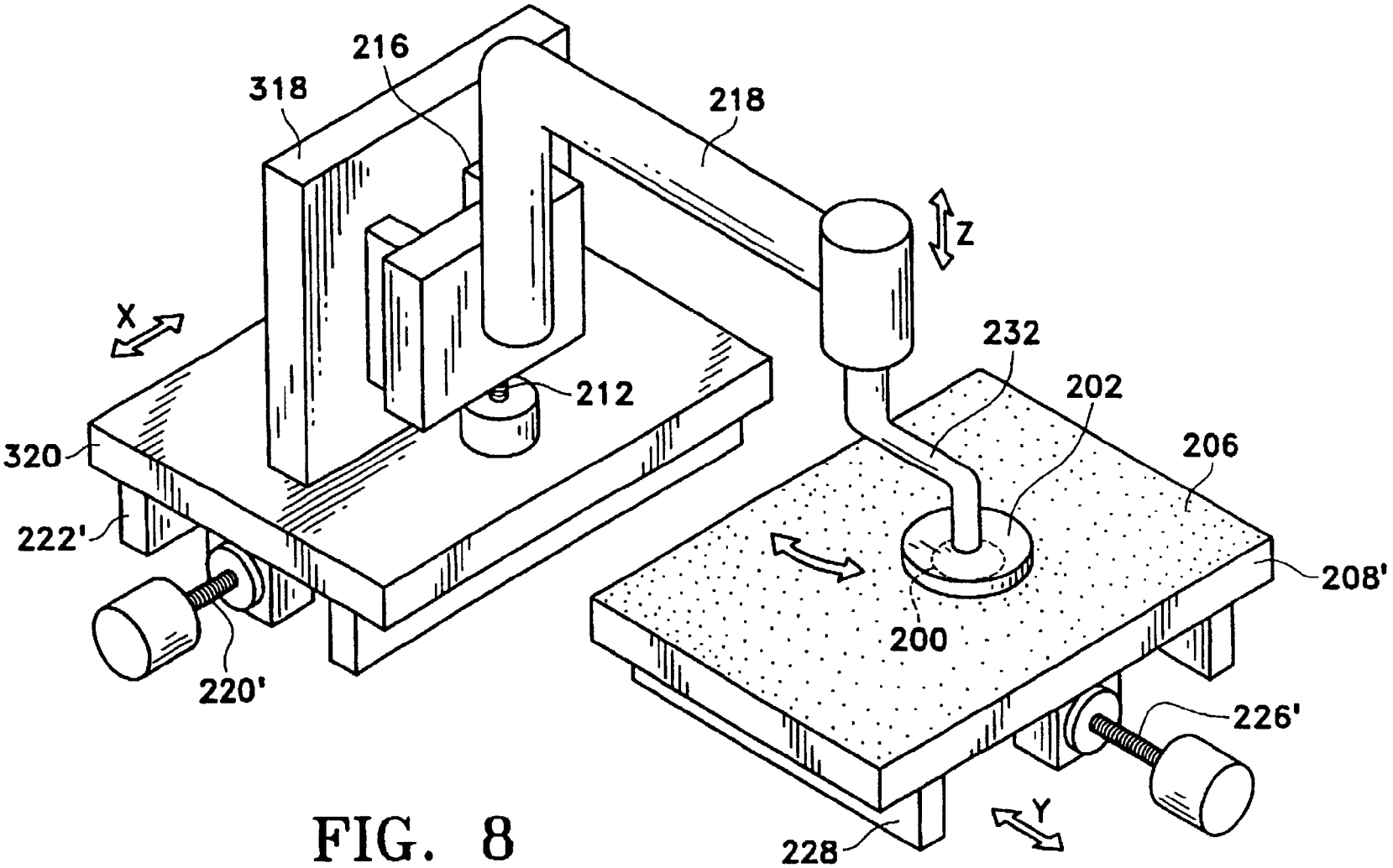
FIG. 8 is a front perspective view of another embodiment of a polishing apparatus according to the present invention.

FIG. 8 is a perspective view of another alternative embodiment according to the invention In this embodiment abrasive pad 206 is mounted to table 208' which moves in the Y-direction by action of linear slide 228' and lead screw 226'. Wafer 200 is held by head 202 which is mounted on eccentric arm 232. Eccentric arm 232 is rotatably mounted to cross-member 218 which is fastened to plate 214. Under action of lead screw 212, plate 214 moves in the Z-direction. In this embodiment, linear slide 216 is slidably mounted to plate 318 which is fixedly mounted to plate 320. Plate 320 moves in the X-direction under action of lead screw 220' and linear slide 222'. Thus in this embodiment, head 202, arm 232, and cross-member 218 move in both the X and Z-directions, while the table 208' moves in the Y-direction. One skilled in the art would recognize that other embodiments are possible. For example, the table may remain stationary in the X and Y-directions, while the head moves in the X and Y-directions.

FIG. 9 is a cross-section side view of tooling head 202, according to one embodiment of the invention. As shown, post 204 is connected to shoulder 260 and provides motion and force in the Z-direction. Shoulder 260 is a solid cylindrical piece, and has a cylindrical guide ball socket 262 at its center which mates with guide ball 264. Guide ball 264 is securely fastened to platen 266 with a bolt or the like. As shown, wafer 200 is contacted by the underside of platen 266. Retaining lip 273 protrudes below the surface of platen 266 and serves to keep the wafer centered on the platen by contacting the edges of the wafer. Guide ball 264 and guide ball socket 262 provide accurate positioning of platen 266 and shoulder 260 in the X and Y-directions. Preferably guide ball 264 fits tightly into guide ball socket 262 such that guide ball 264 allows less than about 0.0002 inch of movement in the X and Y-directions.

Shoulder 260 also contains a circular notch 268 into which fit compression springs 270, which act between shoulder 260 and platen 266. In a preferred embodiment, springs 270 comprise a stack of circular Bellville springs that rest on platen 266. Springs 270 ensure that platen 266 is biased against the wafer and table so that the force in the Z-direction and thus pressure on the wafer can be varied. Therefore by varying the position of shoulder 260 and post 204 in the Z-direction, the pressure between wafer 200 and the abrasive pad may be accurately controlled.

Also shown in FIG. 9 is flexure ring 272, preferably a thin circular steel ring which is mounted to both the perimeter of shoulder 260 and a raised edge portion 267 of platen 266 using annular clamp rings 269 and 271 which are bolted to raised portion 267 and shoulder 260 respectively. Flexure ring 272 transmits cutting forces and torque between shoulder 260 and platen 266 in the X and Y-directions. Flexure ring 272 also allows relative motion in the Z-direction so that force can be transmitted to the wafer, and allows platen 266 to pivot slightly in the Z-direction about guide ball 264, as shown, in order to comply with slight variations in pad angle. However, flexure ring 272 does not allow rotation about the Z-axis. Advantageously, flexure ring 272 and guide ball 264 prevent platen 266 from moving in the X and Y-directions, so that there is no backlash, which can lead to undesirable chattering or vibration when using some polishing patterns.

The embodiments of this invention described above are illustrative only of the principles of this invention and are not intended to limit the invention to the embodiments described herein. In view of this disclosure, those skilled in the art can utilize this invention in a wide variety of applications. For example, one skilled in the art will recognize that the present invention may be used for polishing other disk-shaped objects.

What is claimed is:

1. A method of polishing a wafer comprising the steps of:

holding a wafer having a center, by a wafer carrier while biasing the wafer against a pad for polishing the wafer, relatively moving the wafer and the pad in more than one direction, such that the wafer, when not rotating about its own center, traces a path comprising tangentially connected arcs on the pad with a constant relative velocity with respect to the pad, the improvement comprising the step of;

rotating the wafer about said center while relatively-moving the wafer and the pad in more than one direction such that a relative velocity for at least one point on the wafer with respect to the pad differs from said constant relative velocity by at least 0.1% wherein the step of rotating the wafer further comprises, rotating the wafer carrier while holding the wafer by the wafer carrier.

* * * * *